United States Patent [19]

Lapp

[11] 4,366,673

[45] Jan. 4, 1983

[54] HYDRAULIC AMPLIFIER

[76] Inventor: Ellsworth W. Lapp, c/o Lapp Engineering, 4701 Hydraulic Rd., Rockford, Ill. 61109

[21] Appl. No.: 219,423

[22] Filed: Dec. 23, 1980

[51] Int. Cl.[3] ..... F15B 15/18

[52] U.S. Cl. ..... 60/477; 60/482; 60/486

[58] Field of Search ..... 60/477, 482, 486

[56] References Cited

U.S. PATENT DOCUMENTS 3,898,805 8/1975 Good ..... 60/477

4,151,720 5/1979 Vauderstappen ..... 60/482 X 4,206,603 6/1980 Mekler ..... 60/477

*Primary Examiner*—Harold W. Weakley

*Attorney, Agent, or Firm*—Leydig, Voit, Osann, Mayer & Holt, Ltd.

[57] ABSTRACT

A hydraulic amplifier having a hydraulic motor adapted to drive a high pressure pump for boosting the pressure of low pressure fluid and for supplying high pressure fluid to a hydraulic actuator. The motor also drives a scavenging pump for overcoming high back pressure in the return side of the system. The amplifier is controlled by two valves which may be actuated by manually operating a single lever.

16 Claims, 9 Drawing Figures

HYDRAULIC AMPLIFIER

BACKGROUND OF THE INVENTION

This invention relates to a hydraulic pressure amplifier or intensifier which receives pressure fluid from a low pressure pump and increases the pressure of the fluid automatically to a desired magnitude in order to operate a utilization device. One specific type of utilization device which the amplifier may serve is a single-acting hydraulic actuator having a rod which is advanced in one direction when pressure fluid is admitted into one end of a cylinder. When the pressure fluid is released from the cylinder, a spring returns the rod in the opposite direction.

More specifically, the invention constitutes an improvement over the amplifier disclosed in Lapp U.S. Pat. No. 3,952,516. In that amplifier, a rotary hydraulic motor drives a high pressure pump for boosting the pressure of the low pressure fluid. The motor also drives a scavenging pump which positively induces a negative return line pressure to effect a fast and positive return of the rod of the hydraulic actuator.

SUMMARY OF THE INVENTION

The general aim of the present invention is to provide a relatively compact, lightweight and easy to operate hydraulic amplifier which, when compared with prior amplifiers of the same general type, is capable of operating more effectively with hydraulic systems in which a comparatively high back pressure exists in the return line.

A more detailed object of the invention is to provide an amplifier in which the scavenging pump more effectively purges the return line in order to overcome the back pressure in the system.

Still another object is to provide an amplifier in which the hydraulic motor, the high pressure pump and the scavenging pump are started prior to the time low pressure fluid is admitted to the high pressure pump, the return line being prevented from being flooded with a high volume of fluid between operating cycles.

An important object of the invention is to control the flow of low pressure fluid to the amplifier and the flow of high pressure fluid from the amplifier with two valves which are uniquely arranged to be actuated in an advantageous sequence by a single manual operation.

The invention also resides in the novel construction enabling the amplifier to be used with different types of hydraulic systems, enabling the amplifier to function effectively with pressure fluid of widely varying viscosities, and enabling the parts of the amplifier to be packaged as a comparatively lightweight and compact unit.

These and other objects and advantages of the invention will become more apparent from the following detailed description when taken in conjunction with the accompanying drawings.

DETAILED DESCRIPTION OF THE PREFERRED EMBODIMENT

Figure 1:
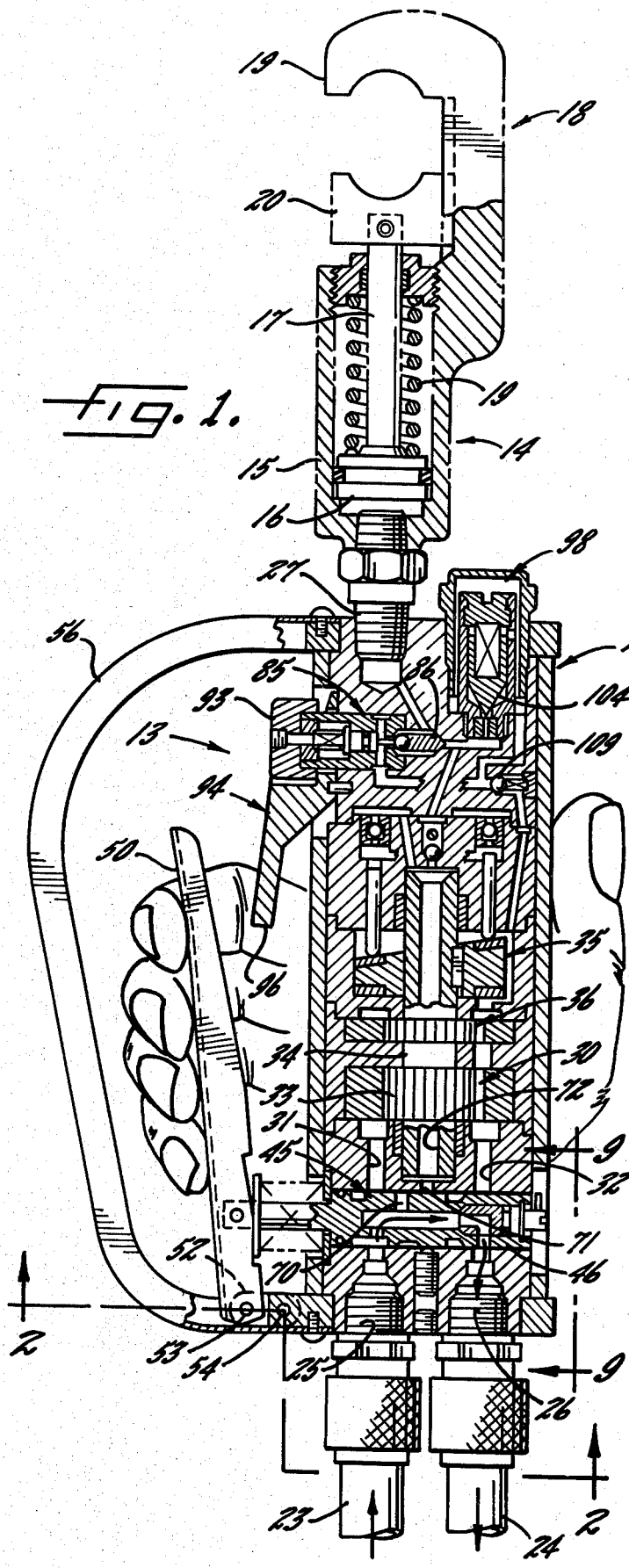
FIG. 1 is a partially structural and partially schematic view of a new and improved hydraulic pressure amplifier incorporating the unique features of the present invention.

The invention is shown in the drawings in conjunction with a hydraulic system in which a low pressure pump 10 (FIG. 4) delivers pressure fluid from a reservoir 11 to a hydraulic pressure amplifier 13. The latter, in turn, boosts the pressure of the fluid automatically to a desired magnitude and is selectively operable to deliver the high pressure fluid to a utilization device 14 (FIG. 1). Herein, the utilization device is shown as being a reciprocating single-acting hydraulic actuator having a cylinder 15 which slidably receives a piston 16 and a rod 17. Advancement of the rod is effected when pressure fluid is admitted into the lower or base end of the cylinder while return of the rod is effected by a spring 19 when the pressure fluid is released from the base end of the cylinder.

A typical application of the hydraulic actuator 14 is for operating a crimping tool 18 which is maneuvered by a worker standing in the bucket of a utility truck boom adapted to be operated by the pump 10. The particular crimping tool which has been shown includes a fixed jaw 19 rigid with the cylinder 15 and a movable jaw 20 carried by the rod 17 and adapted to be shifted toward the fixed jaw to crimp a workpiece (not shown) located between the jaws. The pump 10 is located on and is driven by the truck and, in one particular example, is capable of delivering fluid at an appropriate flow rate and at a pressure range of 1000 to 2500 p.s.i. In most instances, however, it may be necessary to supply fluid to the actuator 14 at a pressure level of between 4,000 and 12,000 p.s.i. The amplifier 13, therefore, may be connected between the pump 10 and the actuator 14 to boost the pressure to the required value. The amplifier may be carried in the boom bucket and may be connected to the pump 10 on the truck by long hoses. Since only low pressure fluid is delivered to the amplifier, plain connecting hoses may be used in place of high pressure wire braid hoses and thus there is no danger of the connecting hoses acting as an electrical ground if the worker should happen to contact high tension wires while operating the tool 18.

In general, the amplifier 13 includes a box-like housing or body 22 which encloses and supports various operating elements of the amplifier. While the body is actually made up by an outer sleeve and several fabricated plates, blocks and the like, these various stationary parts have, for purposes of simplicity, been shown in a somewhat schematic manner and will be collectively referred to as being the body 22. Long flexible hoses or lines 23 and 24 are connected to the lower end of the body and communicate with passages 25 and 26, respectively, in the body. The line 23 conducts low pressure oil to the amplifier 13 from the pump 10 while the line 24 serves to return oil from the amplifier to the reservoir 11. While the actuating cylinder 15 of the tool 18 could be connected to the body by a flexible line, the cylinder herein is connected directly to the upper end of the body by a tubular fitting 27 (FIG. 1). Thus, the amplifier and the tool form a single unit which may be conveniently held and maneuvered by the operator.

Supported within the body 22 is a rotary hydraulic motor 30 (FIG. 4) adapted to receive low pressure hydraulic oil from the pump 10 by way of an inlet passage 31 in the body. The motor is of the gerotor-type and its outlet communicates with a return passage 32 in the body. When the motor is supplied with low pressure oil, its rotor 33 turns a shaft 34 which extends vertically within the body.

The shaft 34 is adapted to drive two pumps, namely, a high pressure pump 35 and a scavenging pump 36. The high pressure pump boosts the pressure of low pressure oil supplied from the pump 10 and delivers high pressure oil to the base end of the cylinder 15 for the purpose of advancing the rod 17 and actuating the crimping tool 18. As the rod is retracted, the scavenging pump 35 draws oil out of the base end of the cylinder and effects a faster and more positive retraction of the rod than is possible when the spring 19 acts alone to force the fluid out of the cylinder against the opposition of the back pressure inherently present in the return line 24 of the system.

In this instance, the scavenging pump 36 also is of the gerotor-type and includes a rotor which is secured to the shaft 34 immediately above the rotor 33 of the motor 30. Oil is sucked into the scavenging pump through a passage 38 (FIG. 4) and is pumped to the reservoir 11 by way of the outlet of the motor 30 and the passage 32.

The high pressure pump 35 includes a swash plate 39 (FIG. 4) adapted to be rotated by the shaft 34 and operable to alternately reciprocate slidably mounted pistons 40. As will be explained subsequently, oil is delivered to the pump 35 by the low pressure pump 10, is pressurized by the reciprocating pistons 40, and then is supplied at high pressure to the base end of the cylinder 15 via passages 41 and 42 (FIG. 4).

In accordance with the present invention, the amplifier 13 is uniquely constructed so as to be compact, light in weight, easy to operate, capable of overcoming relatively high back pressures in the return line 24, capable of being used with different types of hydraulic systems and capable of operating effectively with oil of either high or low viscosity. In large, the foregoing advantages are achieved by novel valving and by conducting the oil to and from the actuator 13 in a novel manner.

Figure 2:
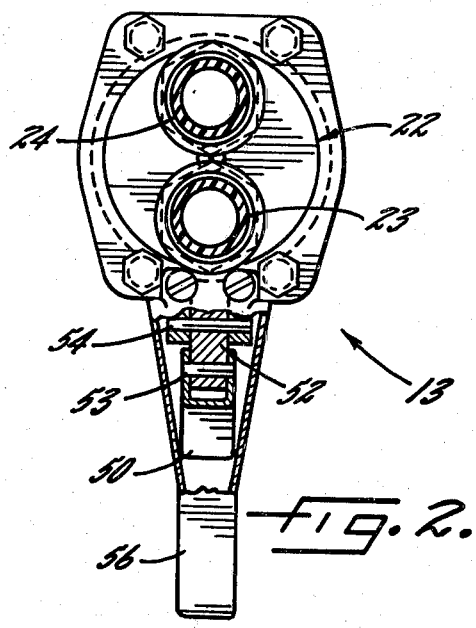
FIG. 2 is a fragmentary cross-sectional view taken substantially along the line 2—2 of FIG. 1.

More specifically, the amplifier 13 includes a main on-off valve 45 (FIG. 4) which controls the flow of low pressure oil. The valve 45 comprises a spool 46 slidably mounted in a bore 47 in the body 22 and having a reduced diameter stem 48 which extends outside of the body. An actuator or operating lever 50 is pivoted near its lower end to the stem 48 as indicated at 51 in FIG. 4. The lower end of the lever is connected to the body by a link 52 which is pivotally connected to the lever and the body at 53 and 54, respectively (FIGS. 2 and 4), so as to enable the lever to pivot back and forth and produce back and forth sliding of the valve spool 46. A coil spring 55 is telescoped over the stem 48 and is compressed between the body 22 and the lever 50 to urge the latter in a counterclockwise direction and normally hold the valve spool 46 in an "off" position shown in FIG. 1. When the lever is manually swung in a clockwise direction by gripping the lever, the valve spool is shifted to the right to an open or "on" position (FIG. 4). Surrounding the lever 50 and secured to the body 22 is a generally U-shaped guard 56 (FIG. 1) which prevents the lever from being inadvertently operated if the amplifier 13 is laid on its side.

Figure 3:
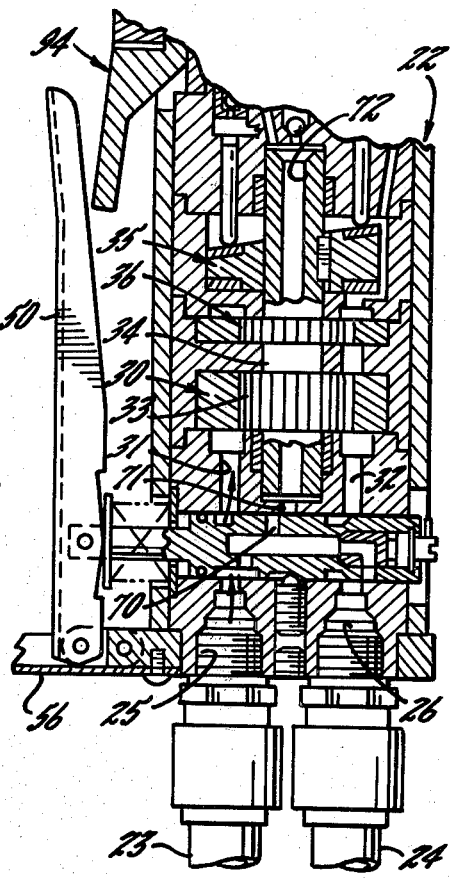
FIGS. 3 to 7 are fragmentary views similar to FIG. 1 and show successive positions which various parts of the amplifier occupy during actuation of the utilization device.
Figure 4:
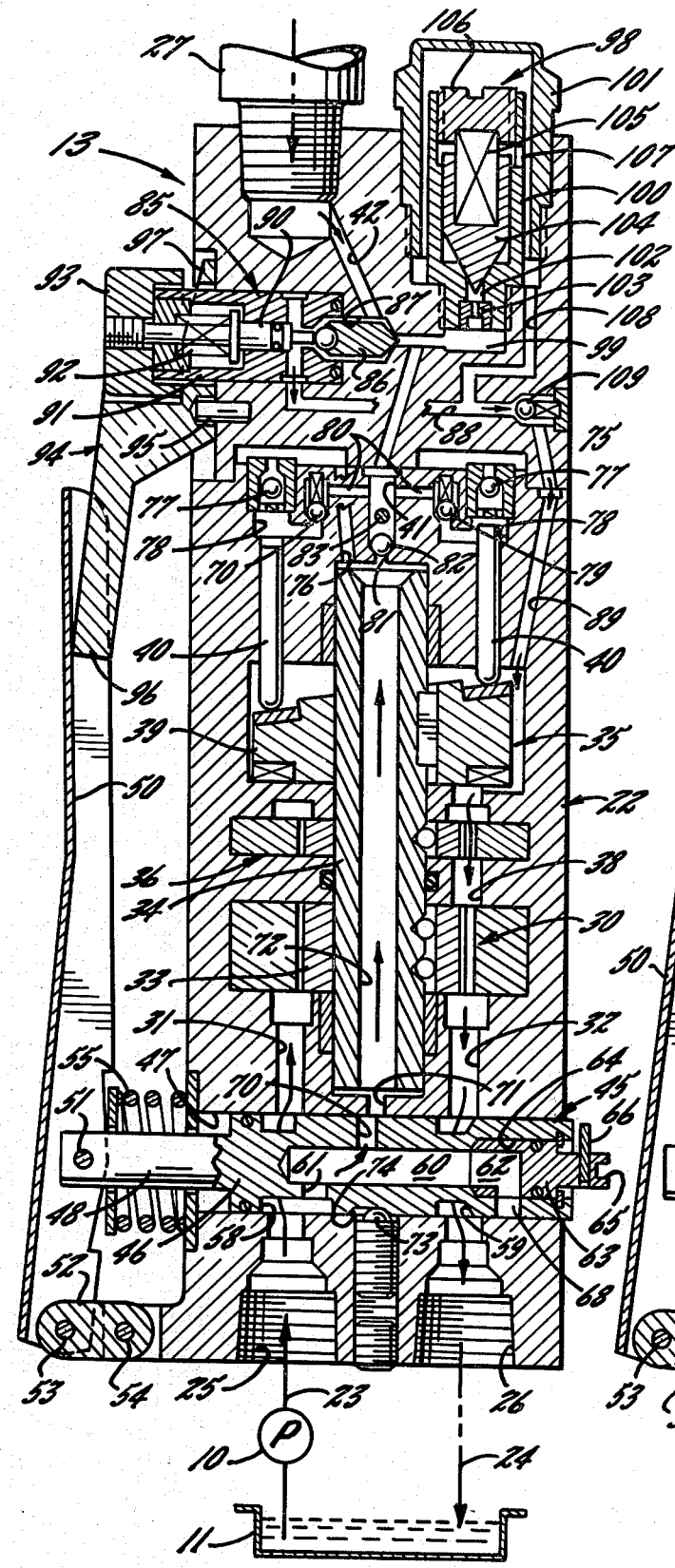

Formed around the valve spool 46 are two axially spaced grooves 58 and 59 (FIG. 4). When the spool is shifted from its "off" position (FIGS. 1 and 8), the groove 58 becomes alined with the passages 25 and 31 as shown in FIGS. 3 and 4 and enables low pressure oil from the line 23 to flow to the inlet of the motor 30. At the same time, the groove 59 moves into alinement with the passages 26 and 32 to enable oil from the passage 32 to return to the reservoir 11 via the line 24. When the spool is in its "off" position, the grooves 58 and 59 are located out of alinement with the passages 31 and 32, respectively, so as to block flow to the passage 31 and from the passage 32 (see FIGS. 1 and 8).

Figure 9:
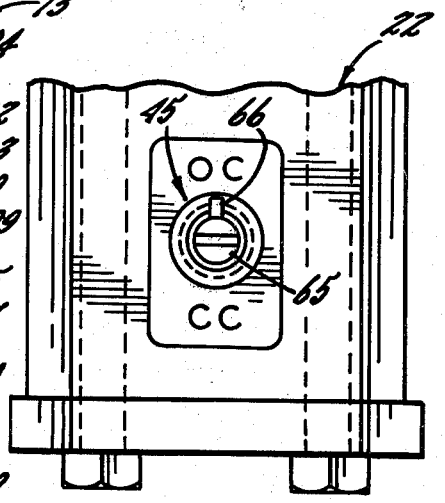
FIG. 9 is an enlarged fragmentary side elevational view taken substantially along the line 9—9 of FIG. 1.

In keeping with the invention, a passage 60 (FIG. 4) is formed in the valve spool 46 and its flow path is adapted to be selectively changed so as to enable the amplifier 13 to be used either with a truck whose pump 10 is designed for use with an open center control valve or with a truck whose pump is designed for use with a closed center control valve. As shown in FIG. 4, the passage 60 extends lengthwise of the valve spool 46 and its left end communicates with the groove 58 by way of a radially extending hole 61 formed in the spool between the passage 60 and the groove 58. The right end of the passage 60 communicates with an L-shaped passage 62 formed in a plug 63 which is rotatably mounted with a snug fit in a bore 64 in the spool 46. A stem 65 on the end of the plug is adapted to be turned by a screwdriver and carries a finger 66 which points to indicia (FIG. 9) on the outer side of the body 22 to indicate whether the plug is turned angularly to an open center (O.C.) position or a closed center (C.C.) position.

When the plug 63 is turned to its open center position and when the valve spool 46 is in its "off" position (FIG. 1), the L-shaped passage 62 in the plug 63 communictes with the return passage 26 by means of a radially extending hole 68 (FIGS. 4 and 8) formed in the spool. As a result, low pressure fluid delivered into the line 23 by the pump 10 flows through the passage 25, into the groove 58, through the hole 61 and into the passage 60 and then returns directly to the reservoir 11 by way of the passage 62, the hole 68, the passage 26 and the line 24. Thus, low pressure oil from the pump 10 is simply returned to the reservoir 11 by way of the valve 45.

If the plug 63 is turned 180 degrees to its closed center position (see FIG. 8), the outlet end of the L-shaped passage 62 is blocked off by the wall of the bore 64 in the valve spool 46. Under these circumstances, there is no flow through the valve 45 as long as the spool 46 is in its "off" position, and the pump 10 goes to a neutral volume mode. Accordingly, the plug 63 enables the valve 45 to be converted so that the amplifier 13 may be used with either an open center or a closed center pump system. The position of the plug 63 does not affect the flow through the valve 45 when the spool 46 is shifted from its "off" position since, in either case, the outlet end of the L-shaped passage 62 is blocked off, either directly by the bore 64 or by virtue of the hole 68 being closed off by the bore 47.

Pursuant to the invention, shifting of the valve spool 46 to its "on" position first causes low pressure fluid to be supplied to the motor 30 in order to drive the high pressure pump 35 and the scavenging pump 36 and thereafter causes low pressure fluid to be delivered to the high pressure pump for pressurization by the pistons 40. In this way, the scavenging pump 36 purges oil from the return side of the system before low pressure oil is introduced into the system and, in addition, the motor 30 is started and gains speed before any load is imposed on the high pressure pump 35.

To achieve the foregoing, a radially extending hole 70 (FIG. 4) is formed through the valve spool 46 and communicates with the passage 60. When the spool 46 is shifted to the right, the hole 70 eventually moves into communication with a hole 71 in the body 22 (see FIGS. 4 and 5). The hole 71, in turn, is alined with a passage 72 which supplies low pressure oil to the high pressure pump 35. In keeping with the invention, the passage 72 is formed through the center of the shaft 34 in order to reduce the size and complexity of the amplifier 13.

Figure 8:
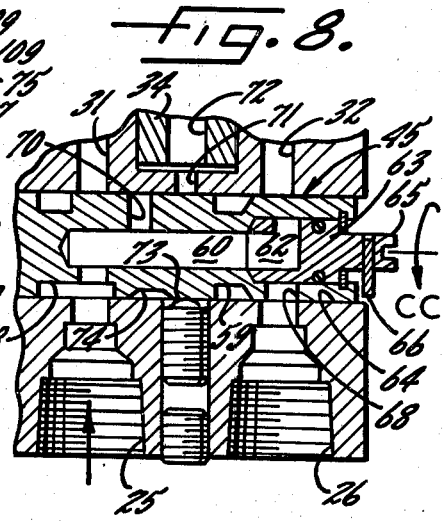
FIG. 8 is an enlarged view of one of the valves illustrated in FIG. 1 but shows the valve in an adjusted position.

When the spool 46 is in its "off" position, the hole 70 is blocked off by the wall of the bore 47 and thus no oil can flow from the passage 60 to the hole 71, the passage 72 or the high pressure pump 35 (see FIGS. 1 and 8). As the spool is initially shifted to the right toward its "on" position, the hole 70 remains blocked when the groove 58 first establishes communication between the passages 25 and 31 and when the groove 59 first establishes communication between the passages 26 and 32 (see FIG. 3). Accordingly, low pressure oil is delivered to the motor 30 but no oil is supplied to the high pressure pump 35. The motor thus starts turning the shaft 34 while there is no load on the high pressure pump 35 and, at the same time, begins driving the scavenging pump 36 to purge the return side of the system and overcome the back pressure in the line 24 before oil from the pump 10 is introduced into the system. When the spool reaches the position (FIG. 3) where oil is supplied to the motor 30, a spring-loaded detent or plunger 73 (FIGS. 4 and 8) enters a cam recess or notch 74 in the spool 46, the plunger being supported by the body 22.

Figure 5:
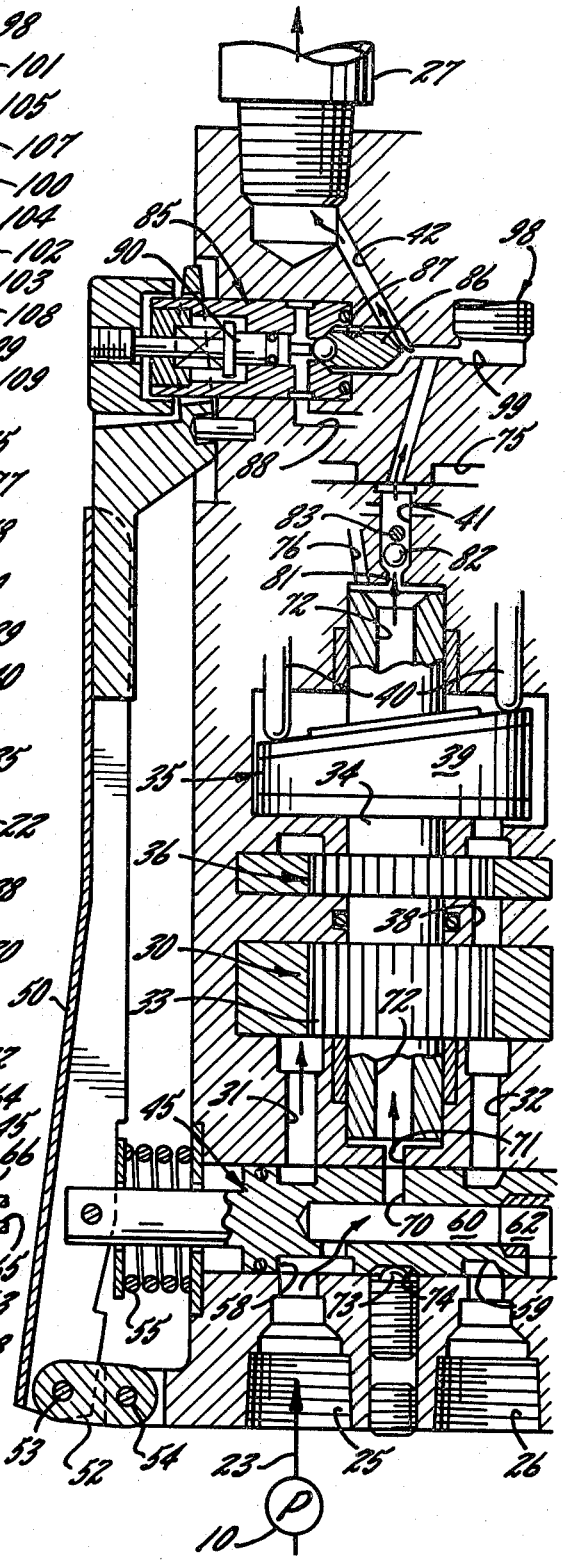

Upon continued shifting of the valve spool 46 to the right to its "on" position (see FIGS. 4 and 5), the hole 70 moves into alinement with the hole 71 and with the passage 72 through the shaft 34. Thus, low pressure oil from the pump 10 is delivered to the high pressure pump 35 via the line 23, the passage 25, the groove 58, the hole 61, the passage 60, the holes 70 and 71 and the passage 72. The plunger 73 remains in the notch 74 when the spool is in its full "on" position (FIG. 5).

Oil pumped upwardly through the passage 72 in the shaft 34 is supplied to a cavity 75 (FIG. 4) in the body 22 via a passage 76. When the pistons 40 of the high pressure pump 35 are reciprocated by the swash plate 39, oil from the cavity 75 flows past check valves 77, is pressurized in the piston chambers 78 and then flows past spring-loaded check valves 79 and through passage 80 to the passage 41. For a purpose to be explained subsequently, the passage 72 is adapted to communicate with a port 81 at the upper end of the passage 72. Flow through the port 81 normally is prevented by a free floating ball-type check valve 82 adapted to move upwardly away from the port and into the passage 41, the upward movement of the ball within the passage being limited by a stop 83 (FIG. 5).

The flow of high pressure oil from the high pressure pump 35 to the cylinder 15 is controlled by a valve 85 which, in accordance with the invention, is actuated in a predetermined sequence with the valve 45 and by the same manual operation which is used to actuate the valve 45. As shown in FIG. 4, the valve 85 includes a valve member 86 which is slidably received in a chamber 87 in the body 22 with substantial radial clearance. The passage 41 from the high pressure pump 35 leads into one end of the chamber 87 while the passage 42 extends between one side of the chamber and the base end of the cylinder 15. Still another passage 88 communicates with the opposite end of the chamber 87 and leads to a passage 89 which communicates with the return passage 32 via the pump 35, the pump 36 and the motor 30.

Normally, the valve member 86 is disposed in the chamber 87 in a closed position (FIG. 4) closing off the passage 41 and preventing that passage from communicating with the chamber 87 and the passage 42. When the valve member 86 is in its closed position, oil from the base end of the cylinder 15 may flow out of the passage 42, through the clearance between the valve member and the chamber 87 and out of the chamber through the return passage 88. To hold the valve member 86 in its closed position, a plunger 90 (FIG. 4) is slidably mounted within a housing 91 in the body 22 and is pressed against the valve member by a coil spring 92, the latter being telescoped over the plunger and being compressed within the housing.

One end portion of the plunger 90 projects outwardly from the housing 91 and is threaded into a knob 93 which is telescoped slidably over the housing. An actuator or operating lever 94 is pivotally connected to the outer side of the body 22 at 95 and includes an end portion 96 which projects downwardly into the path which is followed by the lever 50 when the latter is pivoted in a clockwise direction. The other end portion 97 of the lever 94 is apertured, is telescoped loosely over the housing 91 and is sandwiched between the knob 93 and the outer side of the body 22.

The spring 92 urges the plunger 90 to the right and normally acts to press the plunger against the valve member 86 to hold the latter in its closed position (FIG. 4). In addition, the spring acts through the plunger and the knob 93 to normally hold the lever 94 in the position shown in FIG. 4. When the lever 94 is pivoted counterclockwise from that position, the plunger 90 is pulled away from the valve member 86 and, as a result, the valve member is free to shift to the left to its open position (FIGS. 5 and 6) in the chamber 87.

The amplifier 13 is completed by a pressure relief valve 98 (FIG. 4) which communicates with the passage 41 and the chamber 87 by way of a passage 99. The pressure relief valve 98 includes a housing 100 mounted in the body 22 and covered by a cap 101. A port 102 in the lower end of the housing 100 communicates with the passage 99 and, in keeping with the invention, a flow restrictor 103 with an orifice of small diameter (e.g., 0.025") is threaded into the housing 100 to restrict the flow of oil from the passage 99 to the port 102.

Telescoped into the relief valve housing 100 with radial clearance is a valve member 104 (FIG. 4) which is urged downwardly into seating engagement with the port 102 by a coil spring 105. The latter is compressed between the valve member 104 and a plug 106 which is threaded into the upper end of the housing 100 and which may be adjusted to change the force applied to the valve member by the spring. When the pressure exerted on the valve member 104 reaches a predetermined value (e.g., 12,000 p.s.i.), the pressure overcomes the spring force and shifts the valve member upwardly to permit oil in the passage 99 to flow through the restrictor 103 and the port 102. Such oil flows into the space between the valve member 104 and the housing 100, exits the housing through a hole 107 therein, flows into the space between the housing and the cap 101 and then flows into a passage 108 which connects with the return passage 88. A spring-loaded check valve 109 located at the junction of the passages 88 and 89 prevents oil from flowing reversely from the passage 89 to the passages 88 and 108.

As mentioned previously, clockwise swinging of the actuator lever 50 moves the spool 46 of the on-off valve 45 from its "off" position (FIG. 1) toward its "on" position. The initial movement of the spool is effective to deliver low pressure oil to the motor 30 and effect driving of the pumps 35 and 36. With continued movement of the spool, low pressure oil is supplied to the cavity 75 through the passage 72 in the shaft 34 and is pressurized by the high pressure pump 35. When low pressure oil is initially supplied to the pump 35, the valve members 86 and 104 are in their closed positions and thus the oil which is pressurized by the pump 35 is captivated in the passage 41 and holds the ball 82 against the port 81 so as to prevent oil from flowing from the passage 72 to the passage 41. The pressure in the passage 41 may move the valve member 86 slightly to the left toward its open position but, in such case, oil simply seeps past the valve member 86 and returns to drain via the passage 88.

When the actuating lever 50 is swung clockwise to the position shown in FIG. 4, it engages the actuating lever 94. Continued clockwise swinging of the lever 50 is effective to swing the lever 94 in a counterclockwise direction as shown in FIG. 5 and thereby cause the lever 94 to pull the plunger 90 away from the valve member 86. As a result, the pressure in the passage 41 acts to shift the valve member 86 to the left to establish communication from the passage 41 to the passage 42 and, at the same time, to close off the return passage 88.

Once a flow path is established between the passages 41 and 42, the pressure in the passage 41 is relieved, the pressure in the passage 72 forces the ball 82 away from the port 81, and low pressure oil in the passage 72 flows through the port 81, the passage 41 and the passage 42 to flood the base end of the cylinder 15 (see FIG. 5). As a result, the rod 17 is advanced at rapid rate to quickly shift the movable jaw 20 of the tool 18 into engagement with the workpiece and to squeeze the workpiece between the jaws 19 and 20. Pressure thus builds up in the passage 41 to force the ball 82 downwardly against the port 81 and prevent further flow from the passage 72 to the passage 41 (see FIG. 6). The pressure developed by the high pressure pump 35 in the passages 80 then pressurizes the passages 41 and 42 and the base end of the cylinder 15 to a high value to develop the force necessary to crimp the workpiece. In passing, it should be noted that the high pressure which is developed is sufficient to hold the valve member 86 in its open position (FIG. 6) against the force of the spring 92 even if the operator should happen to release the lever 50 before the crimping operation is completed.

Figure 6:
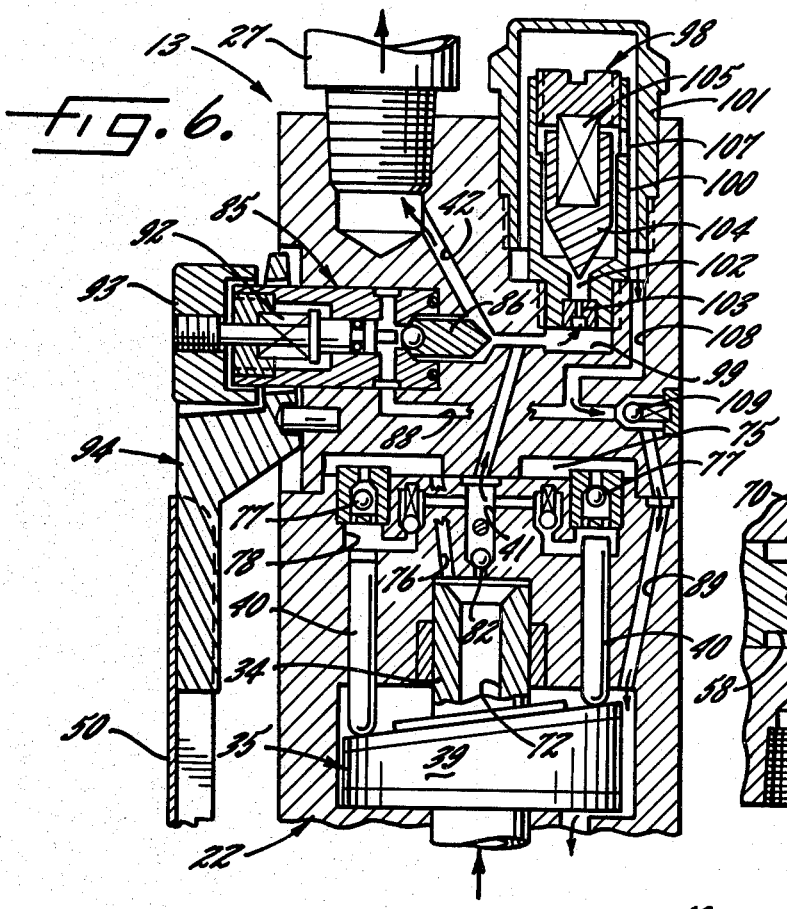
Figure 7:
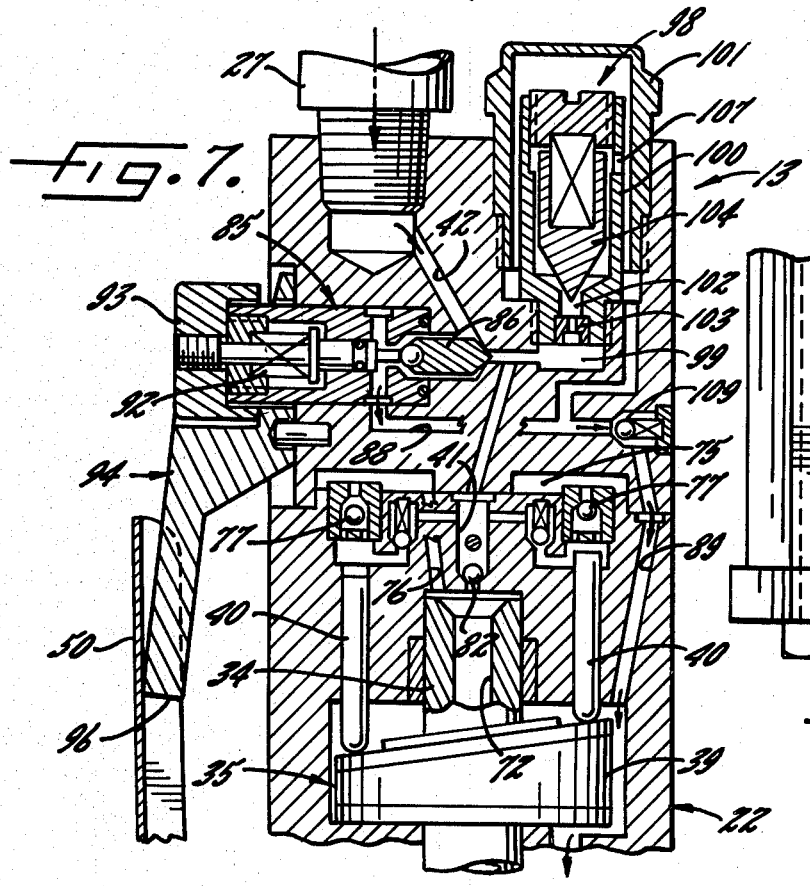

When the pressure in the cylinder 15 reaches the selected high value (e.g., 12,000 p.s.i.), the valve member 104 of the relief valve 98 is forced away from the port 102 to relieve the pressure in the cylinder and in the passages 41 and 99 (see FIG. 6). If the operator has previously released the lever 50, the spring 92 forces the plunger 90 and the valve member 86 to the right to close off the passage 41 and to establish communication between the passages 42 and 88 via the chamber 67 (see FIG. 7). If the lever 50 has not been released previously, the noise which accompanies opening of the relief valve 98 signals the operator to release the lever, whereupon the valve member 86 is shifted to establish communication between the passages 42 and 88. The scavenging pump 36 thus acts to quickly purge the base end of the cylinder 15 of oil so as to enable the spring 19 to effect rapid return of the rod 17 and the movable jaw 20.

After the workpice has been crimped, the operator may release the lever 50 completely and allow the lever to return to the position shown in FIG. 1 or, if the operator wishes to immediately initiate another cycle, the lever may be released only to the position shown in FIG. 3. When the lever 50 reaches the latter position, the right end of the notch 74 engages the detent plunger 73 to apply a slight retarding force to the spool 46 and the lever and thereby signal the operator by "feel" that the lever has been released sufficiently far to start another cycle.

The foregoing arrangement provides numerous advantages over the amplifier disclosed in my prior patent identified above. First, the valve 45 can be easily adjusted for use with either an open center system or a closed center system. In addition, the valve 45 allows the motor 30 to start driving the high pressure pump 35 before load is imposed on that pump by the low pressure oil. The scavenging pump 36 also is driven prior to the flow of low pressure oil into the system and can effectively purge the return side of the system even if a back pressure in the neighborhood of 800 p.s.i. exists in the return line 24. The ball valve 82 prevents the system from being flooded with low pressure oil prior to opening of the valve member 86 and enables the rod 17 to be rapidly advanced once the valve member 86 is opened. The restrictor device 103 at the inlet of the relief valve 98 makes the relief valve more responsive to pressure and less dependent upon flow. The valve member 104 of the relief valve thus will operate in a stable and nonerratic manner with oil of either high or low viscosity and will effectively re-seat even if the oil is cold and thick.

Even though the amplifier 13 includes two valves 45 and 85 which must be actuated manually, the actuation may be effectived quickly and easily by virtue of the end portion 96 of the lever 94 lying in the path of the lever 50. With this arrangement, the operator need concern himself only with actuating the lever 50 to control both of the valves 45 and 85. When the lever 50 is completely released, the motor 30 is idle and need not be shut off by a separate operation.

As compared with my prior amplifier, the present amplifier 13 is of compact construction and is sufficiently light in weight so as to be capable of being held in the operator's hands. Thus, the tool 18 can be connected directly to the amplifier 13 rather than being connected thereto by flexible lines.

I claim:

1. A hydraulic amplifier operable to receive low pressure fluid from a low pressure pump, to increase the pressure of said fluid and to deliver high pressure fluid to a hydraulic utilization device, said amplifier comprising a hydraulic motor, a high pressure pump, means for connecting said motor to said high pressure pump and operable to drive said high pressure pump when said motor is actuated by low pressure fluid supplied by said low pressure pump, said high pressure pump being operable when driven and when supplied with low pressure fluid from said low pressure pump to increase the pressure of such fluid, the improvement in said amplifier comprising, a first valve normally disposed in a first position blocking the flow of low pressure fluid from said low pressure pump to said motor and to said high pressure pump, said first valve being movable to a second position permitting low pressure fluid to flow from said low pressure pump to said motor and to said high pressure pump, a second valve normally disposed in a first position blocking the flow of high pressure fluid from said high pressure pump to said utilization device, said second valve being movable to a second position permitting high pressure fluid to flow from said high pressure pump to said utilization device, a first actuator associated with said first valve and operable when manually moved in one direction to cause said first valve to shift from its first position to its second position, a second actuator associated with said second valve and operable when moved in a predetermined direction to cause said second valve to shift from its first position to its second position, said first actuator being operable when moved in said one direction to first cause said first valve to shift to its second position and then to move said second actuator in said predetermined direction to cause said second valve to shift to its second position.

2. A hydraulic amplifier as defined in claim 1 in which said first valve passes through an intermediate position as said first valve is moved from its first position to its second position, said first valve being operable when in said intermediate position to permit low pressure fluid to flow from said low pressure pump to said motor and to block the flow of low pressure fluid from said low pressure pump to said high pressure pump.

3. A hydraulic amplifier as defined in claim 2 further including a recess in said first valve, and a spring-loaded detent disposed adjacent said first valve and located to enter into said recess when said first valve is in its intermediate and second positions.

4. A hydraulic amplifier as defined in claim 1 further including a housing enclosing said motor, said high pressure pump and said valves, said first and second actuators comprising first and second levers, respectively, pivotally connected to said housing, said second lever being disposed within the path followed by said first lever when the latter is moved in said one direction and being pivoted in said predetermined direction by said first lever after the latter has been moved a preselected distance along said path.

5. A hydraulic amplifier as defined in claim 1 in which said means for connecting said motor to said high pressure pump comprise a rotatable shaft extending between said motor and said high pressure pump, and a passage formed in said shaft and establishing communication from said low pressure pump to the inlet of said high pressure pump when said first valve is in its second position.

6. A hydraulic amplifier as defined in claim 1 further including a low pressure passage communicating with the inlet of said high pressure pump, a high pressure passage establishing communication between the outlet of said high pressure pump and said second valve, a supply passage communicating with said low pressure passage for supplying low pressure fluid from said low pressure pump to said low pressure passage and to the inlet of said high pressure pump when said first valve is in its second position, said supply passage also being adapted to communicate with said high pressure passage, and pressure responsive means in said high pressure passage for blocking communication between said supply passage and said high pressure passage when said first valve is in its second position and when said second valve is in its first position, said pressure responsive means automatically establishing communication between said supply passage and said high pressure passage when said second valve is first moved to its second position and thereafter automatically re-blocking communication between said supply passage and said high pressure passage when the pressure in the latter passage builds up to a predetermined value.

7. A hydraulic amplifier as defined in claim 6 in which said means for connecting said motor to said high pressure pump comprise a rotatable shaft extending between said motor and said high pressure pump, said supply passage extending axially through said shaft.

8. A hydraulic amplifier as defined in claim 1 in which said first valve includes a passage which establishes communication between the outlet of said low pressure pump and a reservoir associated with said low pressure pump when said first valve is in its first position, and means for selectively adjusting said first valve to cause said first valve to block communication between the outlet of said low pressure pump and said reservoir through said passage when said first valve is in its first position.

9. A hydraulic amplifier as defined in claim 1 in which said second valve comprises a chamber and further comprises a valve member shiftable between first and second positions within said chamber, a high pressure passage extending between said high pressure pump and said chamber, a drain passage extending between said chamber and a reservoir associated with said low pressure pump, and a supply-return passage extending between said chamber and said utilization device, said valve member establishing communication between said supply-return passage and said drain passage and blocking communication between said supply-return passage and said high pressure passage when said valve member is in its first position, said valve member establishing communication between said supply-return passage and said high pressure passage and blocking communication between said supply-return passage and said drain passage when said valve member is in its second position, said second actuator comprising a slidable plunger engageable with said valve member and operable when in engagement with said valve member to hold the latter in its first position, means biasing said plunger into engagement with said valve member, said first actuator shifting said plunger out of engagement with said valve member against the action of said biasing means when said first actuator is moved in said one direction, said valve member being responsive to the pressure in said chamber and shifting to its second position when said plunger is out of engagement with said valve member and when said first valve is in its second position.

10. A hydraulic amplifier as defined in claim 9 further including a normally closed relief valve which opens automatically when the pressure of said high pressure fluid exceeds a predetermined value, said relief valve having an inlet communicating with said high pressure passage and communicating wih said supply-return passage when said valve member is in its second position, and a flow restricting device in the inlet of said relief valve.

11. A hydraulic amplifier operable to receive low pressure fluid from a low pressure pump, to increase the pressure of said fluid, and to deliver high pressure fluid to a hydraulic utilization device, said amplifier being selectively operable to conduct fluid from said utilization device to a reservoir associated with said pump, said amplifier comprising a hydraulic motor connected to receive and be actuated by part of the low pressure fluid delivered from said pump, a high pressure pump connected to receive part of the low pressure fluid delivered from said low pressure pump and operable when driven to increase the pressure of such fluid, means connecting said high pressure pump with said motor and operable to drive said high pressure pump when said motor is actuated, and a scavenging pump connected to be driven by said motor and having an outlet adapted to communicate with said reservoir, the improvement in said amplifier comprising, a first valve normally disposed in a first position blocking the flow of low pressure fluid from said low pressure pump to said motor and to the inlet of said high pressure pump and blocking the flow of fluid from the outlet of said scavenging pump to said reservoir, said first valve being movable in one direction from said first position to an intermediate position and then to a second position, said first valve being operable when in said intermediate position to permit low pressure fluid to flow from said low pressure pump to said motor, to permit fluid to flow from said scavenging pump to said reservoir and to block the flow of low pressure fluid from said low pressure pump to said high pressure pump, said first valve being operable when in said second position to permit low pressure fluid to flow from said low pressure pump to said motor and said high pressure pump and to permit fluid to flow from said scavenging pump to said reservoir, and a second valve normally disposed in a first position blocking the flow of high pressure fluid from said high pressure pump to said utilization device and permitting fluid to flow from said utilization device to said scavenging pump, said second valve being manually movable to a second position when said first valve is in its second position, said second valve being operable when in its second position to permit the flow of high pressure fluid from said high pressure pump to said utilization device and to block the flow of fluid from said utilization device to said scavenging pump.

12. A hydraulic amplifier as defined in claim 11 further including a first actuator associated with said first valve and operable when manually moved in one direction to cause said first valve to shift from its first position to its intermediate position and then to its second position, a second actuator associated with said second valve and operable when moved in a predetermined direction to cause said second valve to shift from its first position to its second position, said first actuator being operable when moved in said one direction to first cause said first valve to shift from its first position to its second position and thereafter to engage said second actuator to move said second actuator in said predetermined direction and cause said second valve to shift to its second position.

13. A hydraulic amplifier as defined in claim 11 in which said means for connecting said motor to said high pressure pump comprises a rotatable shaft extending between said motor and said high pressure pump, a passage extending axially through said shaft and establishing communication from said low pressure pump to the inlet of said high pressure pump when said first valve is in its second position, communication between said passage and said low pressure pump being blocked by said first valve when the latter is in its first and intermediate positions.

14. A hydraulic amplifier as defined in claim 11 further including a low pressure passage communicating with the inlet of said high pressure pump, a high pressure passage establishing communication between the outlet of said high pressure pump and said second valve, a supply passage communicating with said low pressure passage for supplying low pressure fluid from said low pressure pump to said low pressure passage and to the inlet of said high pressure pump when said first valve is in its second position, said supply passage also being adapted to communicate with said high pressure passage, and pressure responsive means in said high pressure passage for blocking communication between said supply passage and said high pressure passage when said first valve is in its second position and when said second valve is in its first position, said pressure responsive means automatically establishing communication between said supply passage and said high pressure passage when said second valve is first moved to its second position and thereafter automatically re-blocking communication between said supply passage and said high pressure passage when the pressure in the latter passage builds up to a predetermined value.

15. A hydraulic amplifier as defined in claim 14 further including a normally closed relief valve which opens automatically when the pressure of said high pressure fluid exceeds a predetermined value, said relief valve having an inlet communicating with said high pressure passage, and a flow-restricting device in the inlet of said relief valve.

16. A hydraulic amplifier operable to receive low pressure fluid from a low pressure pump, to increase the pressure of said fluid, and to deliver high pressure fluid to a hydraulic utilization device, said amplifier being selectively operable to conduct fluid from said utilization device to a reservoir associated with said pump, said amplifier comprising a hydraulic motor connected to receive and be actuated by part of the low pressure fluid delivered from said pump, a high pressure pump connected to receive part of the low pressure fluid delivered from said low pressure pump and operable when driven to increase the pressure of such fluid, a shaft connecting said high pressure pump with said motor and operable to drive said high pressure pump when said motor is actuated, and a scavenging pump connected to be driven by said shaft and having an outlet adapted to communicate with said reservoir, said amplifier being characterized in that a passage is formed axially through said shaft to establish communication between said low pressure pump and the inlet of said high pressure pump, a first valve movable between a first position preventing the flow of low pressure fluid from said low pressure pump to said passage and a second position permitting such flow, and a second valve selectively movable between a first position connecting the inlet of said scavenging pump with said utilization device and a second position connecting the outlet of said high pressure pump with said utilization device.

* * * * *